United States Patent [19]

Bridges

[11] 4,432,929

[45] Feb. 21, 1984

[54] PULSED NEUTRON GENERATOR TUBE POWER CONTROL CIRCUIT

[75] Inventor: James R. Bridges, Houston, Tex.

[73] Assignee: Halliburton Company, Duncan, Okla.

[21] Appl. No.: 284,297

[22] Filed: Jul. 17, 1981

[51] Int. Cl.[3] ..... G21G 4/02

[52] U.S. Cl. ..... 376/119; 376/191; 376/199; 166/64; 166/336

[58] Field of Search ..... 376/119, 191, 199; 166/247, 336, 64, 113

[56] References Cited

U.S. PATENT DOCUMENTS

| | | | |
|---|---|---|---|
| 3,719,827 | 3/1973 | Dennis | 376/119 |
| 4,092,545 | 5/1978 | Langford | 376/119 |
| 4,288,696 | 9/1981 | Peelman | 376/119 |

*Primary Examiner*—Donald P. Walsh
*Attorney, Agent, or Firm*—W. J. Beard

[57] ABSTRACT

For use in providing control of a pulsed neutron generator tube and its associated power supplies, the preferred and illustrated embodiment of the control circuit senses the operative condition of the pulsed neutron generator tube by observing external insulating gas pressure of the sealed tube to monitor for a loss of pressure, target current magnitude, pulsing of the ion source, current flow for the replenisher and operation of the high voltage power supply. This system functions as an interlock, thereby enabling operation of the tube if nominal operative conditions are achieved. Conversely, the absence of nominal operative conditions switches the equipment off to protect the tube from damage resulting from malfunction.

12 Claims, 2 Drawing Figures

42
B+
47
48
49
S
D
Q
C
Q̄
R
75
51
33
56
43
76
57
59
HIGH VOLTAGE POWER SUPPLY
58
63
62
65
44
60
81
55
69
68
38
45
70
79
37
PULSE RATE COUNTER
64
46
HIGH VOLTAGE POWER SUPPLY
57
54
39
73
40
71
72
CLOCK
52
74

PULSED NEUTRON GENERATOR TUBE POWER CONTROL CIRCUIT

BACKGROUND OF THE DISCLOSURE

The invention described below is a control circuit cooperative with a pulsed neutron generator tube. Such a tube also requires certain power supplies.

Well logging techniques utilizing pulsed neutron irradiation are commercially attractive techniques. Through the pulsed neutron technique, the thermal neutron lifetime or the thermal neutron decay time of the strata of the earth formations in the near vicinity of a well are tested and analyzed. This enables compilation of elemental constituents and a variety of information can be obtained. As an example, the porosity of particular strata can be determined in the near vicinity of a borehole.

Typically, such devices comprise an evacuated tube enclosing a deuterium-tritium accelerator source. The neutron source is typically an evacuated and sealed glass, metal or ceramic housing comprising an outer envelope. Operative equipment within the envelope comprises a target which is electrically insulated and maintained at a relatively high potential. Another element is a source of ions to be accelerated toward the target by the high voltage maintained at the target. There is additionally a replenisher element to stablize the gas pressure within the evacuated envelope. Relatively low pressures are desirable for operation of the device.

The apparatus has a replenisher which incorporates a heater element surrounded by a surface capable of absorbing or emitting gas molecules into the evacuated tube envelope dependent on the temperature of the heater element. This enables the pressure within the chamber to be controlled. When the surface is heated, thermal emission of absorbed gases occurs. On cooling, the surface absorbs the gases from the atmosphere. The pressure of gas within the housing controls the supply of positively charged ions for acceleration toward the target, and, therefore, adjusts the rate of production of neutrons. This gas is ordinarily deuterium or deuterium mixed with tritium. Typically, the target is impregnated with tritium.

The electrostatic repulsive force between accelerated ions and the nuclei of tritium atoms at the target is overcome to enable nuclear fusion. This produces an unstable helium isotope (N=5) which decays by neutron emission of approximately 14 MEV energy level.

Operation of the tube during a logging run must be stabilized in a certain pattern. High output is generally desirable to promote an adequate irradiation. On the other hand, consistency is also desirable, at least in the form of a desired average current level to avoid source induced drift in the data. Moreover, the tube is pulsed periodically. The manner and technique of pulsing is, in part, set forth in U.S. Pat. No. 4,264,823 incorporated herein by reference.

Operation of a pulsed neutron generator tube thus requires cooperation of the supporting structure. One supporting structure is the power supply which forms the replenisher current. It is a fairly large current, typically ranging around two amperes. Accordingly, the oilwell logging tool must include a replenisher current supply capable of going as high as about five amperes maximum. The present invention includes an interlock system cooperative with the replenisher current supply to protect the pulsed neutron generator tube in the event of failure of the replenisher current power supply.

In similar fashion, the ion source must be pulsed with a relatively large voltage pulse, a typical value being in the range of about 2,000 volts. There is, therefore, incorporated in this disclosure supporting structure which is a high voltage pulsed power supply for the ion source. This disclosure sets forth a control circuit which interlocks with that source.

The target is impressed with a relatively high voltage. A high voltage power supply capable of perhaps 100,000 volts is normally required. In the event a malfunction deprives the target of its high voltage while replenisher current is applied to the neutron generator tube, the device may be damaged.

The target current is of interest. There is a range of current levels that is desirable for proper operation. If the target current is outside that range, it is indicative of damage. Excessive current may well damage the device. A current which is too low is indicative of other malfunctions.

A typical pulsed neutron generator tube is obtained from Kaman Sciences Corporation of Colorado Springs, Colo. The device is packaged within an evacuated chamber pressurized by SF6 (sulphur hexafluoride) gas. A loss cf gas typically indicates an alarm condition. The system for driving the pulsed neutron generator tube is set forth in the previously referenced patent. This enables the tube to form neutron irradiation in a time dependent pattern to accomplish desired results. The system includes the tube enclosed within a fluid tight sonde suspended by a well logging cable in a borehole. The logging cable conducts signals of interest to the surface. Control and recording equipment are normally located at the surface.

BRIEF DESCRIPTION OF THE INVENTION

This disclosure sets forth an interlock system for a pulsed neutron generator tube. The present system enables the tube to be switched on and operated by bringing certain signals or voltage levels to the tube in a selected sequence. Moreover, it interlocks against the loss of a supply voltage or current to thereby protect the tube against malfunction. This interlock circuit thus monitors the described parameters for operation of the tube and switches the tube off should a malfunction occur. It also monitors envelope pressure, the loss of which may also signal a catastrophic malfunction. The circuit utilizes digital components to form a fail safe system whereby operation of the tube occurs in a controlled fashion to prevent damage resulting from operation without adequate gas.

DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

The single drawing (1A and 1B) is a schematic of the control circuit of the present disclosure which functions as an interlock with a pulsed neutron generator tube also shown in the schematic.

DETAILED DESCRIPTION OF THE PREFERRED EMBODIMENT

Figure 1A:
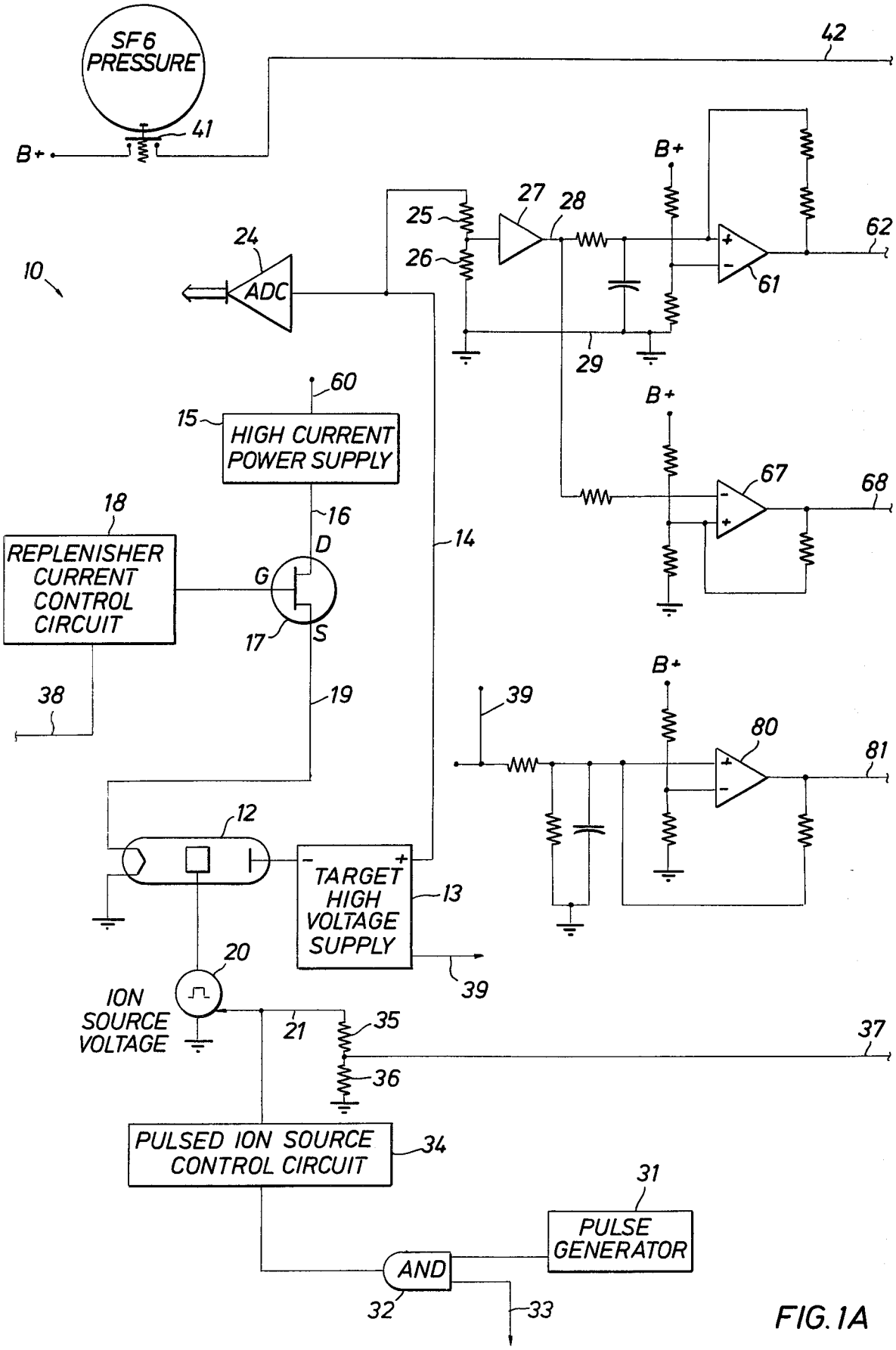
Figure 1B:
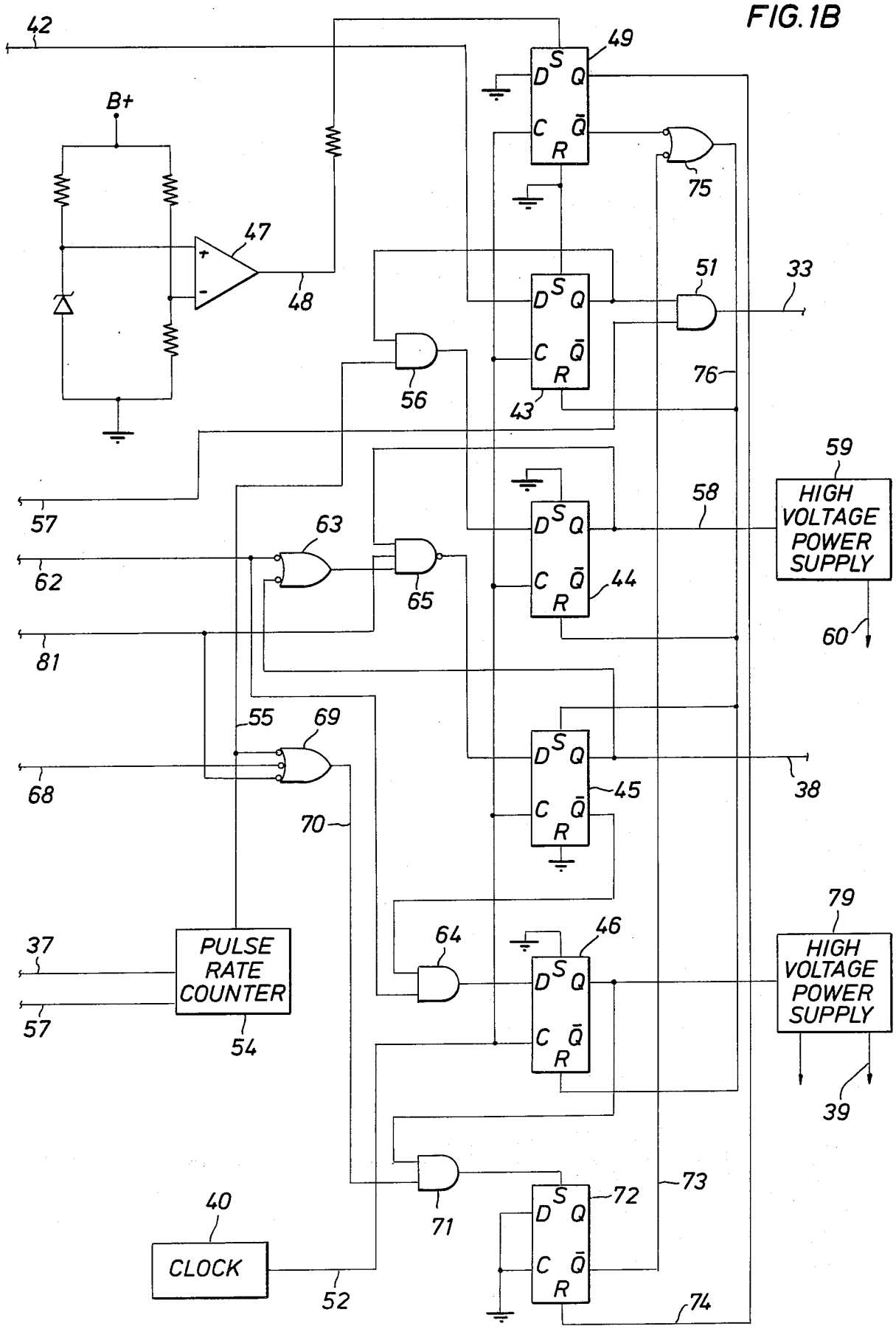

Attention is directed to the only drawing which sets forth the control circuit of the present disclosure which is identified generally by the numeral 10. The control circuit 10 cooperates with certain support equipment which should be described first. It is described first to provide the context of the control circuit. The numeral 12 identifies a pulsed neutron generator tube. A typical source of manufacture is Kaman Sciences Corporation. A typical model is A520. It is provided with a target high voltage supply 13. This typically provides up to about 100 kilovolts. The negative terminal is connected to the target within the tube. The positive terminal is connected to a conductor 14 which provides the target current output. More will be noted concerning the conductor 14. The device also includes a high current supply 15. This supply provides up to about five amperes maximum. The output current is provided through a conductor 16. The conductor 16 is connected to a power transistor. The transistor 17 is a VMOS power FET. The gate terminal of transistor 17 is controlled by a signal from a replenisher current control circuit 18. The controlled replenisher current flows through a conductor 19 to the replenisher filament within the tube 12 and then flows to ground.

In addition, there is an ion source 20 associated with the tube 12. It is switched with pulses periodically supplied to a conductor 21 as will be described.

Certain of the apparatus is also disclosed in the referenced patents. As an example, the referenced patent sets forth a control circuit for the replenisher current.

The target current flows in the conductor 14 and is communicated with an analog to digital converter 24. The analog to digital converter 24 forms an output monitor of data coupled from the borehole through the well logging cable for use at the surface. The target current is also provided through series resistors 25 and 26 to ground. The resistors 25 and 26 form a voltage divider. A small current flows through the two resistors because the resistance is relatively high, and an output voltage is formed which is proportional to the target current. This samples the target current.

The target current is converted into a voltage level by an amplifier 27, and the voltage level signal is then provided at a pair of conductors 28 and 29.

The tube 12 is provided with periodic voltage pulses for the ion source 20. A pulse generator 31 forms a procession of pulses. The pulses are input to an AND gate 32. A signal on a conductor 33 enables the AND gate 32 to deliver output pulses pulses to the pulsed ion source control circuit 34. This circuit forms an output signal on the conductor 21 previously mentioned. In addition, the output signal is provided through a resistance voltage divider including resistors 35 and 36 which form a selected voltage level on a conductor 37. The conductor 37 communicates with other parts of the circuit as will be described.

The replenisher current control circuit is subject to control provided by a signal on a conductor 38. The target high voltage supply 13 is controlled by a signal supplied on the conductor 39 which enables the high voltage supply to operate. If the signal on the conductor 39 is absent, the device will not form the high voltage necessary for operation of the neutron tube 12.

Other circuitry comprises a clock 40. The clock 40 forms pulses at a rate typically in the range of one to one hundred hertz. The tube 12 is externally insulated from the metal tool case with SF6 gas under pressure. A spring opposed pressure responsive switch 41 responds to the external SF6 gas pressure. If the pressure is sufficiently high, the switch is closed and forms a signal on the conductor 42. If the pressure is too low, the absence of a signal on the conductor 42 is indicative of an alarm condition. The selected safe valve of external gas pressure is dependent on the force of the spring which opposes closure of the switch 41.

Operation of the device begins with the application of B+ to the equipment. When this occurs, four particular flip flops are reset. The four flip flops are identified by the numerals 43 through 46 inclusive. The first flip flop 43 controls operation of the ion source; the second flip flop 44 controls operation of one high voltage source while a third flip flop 46 controls operation of another high voltage source. The last flip flop 45 controls turn of of the replenisher current. The four flip flops 43–46 are reset via flip flop 49 and gate 75 when the circuit is activated.

Proper B+ voltage is tested by a voltage differential amplifier 47 which forms an output voltage level indicative of inadequate voltage. If the B+ voltage is not adequate, the amplifier 47 functions as a comparator and does not form the output required for operation. In other words, a reset pulse is formed when the proper voltage occurs at the amplifier 47. It will be observed to have inputs which are responsive to B+. An inadequate B+ input forms a false output signal on conductor 48 which, in turn, sets the flip flop 49. The flip flop 49 resets flip flops 43–46.

The flip flop 49 thus functions as a power on reset flip flop. It controls the other four flip flops 43–46 by resetting them when it operates.

Assume that adequate external SF6 gas pressure at the tube 12 exists. In this event, the pressure is sensed by the switch 41 which closes. This provides B+ voltage through the switch on the conductor 42. Only if gas pressure is adequate will the signal permit operation. Accordingly, the conductor 42 is input to the flip flop 43. The presence of a true signal on the conductor 42 triggers the flip flop to form an output signal which is then conveyed to AND gate 51 which forms an output on the conductor 33 previously mentioned. This enables the ion source with pulses for its operation.

In the drawings, the clock 40 forms pulses at a pulse rate which is suitable for the integrated circuit components used in the device. The clock pulses are delivered on a line 52 to the clock input of the several flip flops mentioned to this juncture. This gates the flip flops in operation. Moreover, the clock line 52 is input to several other components as will be described.

The conductor 37 extends from the pulsed ion source control circuit 34 through the sampling circuit. If high voltage ion source pulses are being formed, the conductor 37 inputs the pulses to several gates. The conductor 37 is input to a pulse rate counter 54. The output of the pulse rate counter is on the conductor 55. The conductor 55 provides an input to the AND gate 56 which latches when a high or true output is obtained from the gate 43, and the output of AND gate 56 is then input to the flip flop 44.

The numeral 57 identifies an input conductor indicative of ion source control which communicates a control signal from the control equipment at the surface (not shown). This conductor 57 provides an input to the AND gate 51 to enable that gate which forms the ion source drive signal on the conductor 33 as previously described.

The flip flop 43 turns on the ion source by way of the signal on the conductor 33. The flip flop 44 turns on a high voltage supply by means of a signal on the conductor 58. The conductor is provided for control of a high voltage power supply 59. The power supply 59 has an output conductor 60. This is the supply input to the high current supply 15. In other words, the high current supply for the replenisher current will not operate unless it is provided power on the conductor 60 for its operation. The supply is, therefore, under control of the signal on the conductor 58.

Once current has been established in the replenisher circuit, it is desirable to sample the target current. The target current is sampled and a voltage is developed which is proportional to the target current. This is accomplished by the voltage divider including resistors 25 and 26, the amplifier 27, and is applied on the conductors 28 and 29. There are two alarm conditions which might occur. These are a replenisher current which is too low and a replenisher current which is too high. The conductors 28 and 29 are input through a differential amplifier 61 with associated reference resistor circuitry to respond to a target current sample voltage set at a particular point. With a typical neutron tube, it is desirable that the target current exceed 50 microamperes. This is a scale value and can be changed by modification of the reference resistors. The differential amplifier 61 forms an output on the conductor 62. When the target current is low, the output is low (false). When the target current exceeds the required value, the signal on the conductor 62 is high (true).

The conductor 62 provides an input to the NOR gate 63 and also to the AND gate 64. The NOR gate 63 drives AND gate 65. The AND gate output drives the flip flop 45. The AND gate 64 output drives the flip flop 46.

Just as it is possible for the current to be out of a desired range by being too low, it is possible that the current might be too high. To this end, the conductor 28 also provides an input to another differential amplifier 67 with appropriate reference voltage circuitry and resistor values selected to form a low output in the event the target current exceeds a specified level. For a particular model of neutron generator tube, this corresponds to about 200 microamperes. In other words, if the current is too high, a signal is formed on the conductor 68 which goes low when the specified maximum target current is exceeded. The conductor 68 is input to the NOR gate 69. The gate 69 receives the output of the pulse counter 54. There is a third input to the gate 69 to be described. The NOR gate 69 forms an output signal on the conductor 70 which is input to AND gate 71. The AND gate 71 provides its output to the indicator terminal of a flip flop 72. The flip flop 72 is a malfunction flip flop. It forms an output signal on the conductor 73 indicative of a malfunction. It is reset by a signal provided on the conductor 74. The output of malfunction flip flop 72 on the conductor 73 is supplied to NOR gate 75 in conjunction with the normal high output of the flip flop 49. The NOR gate 75 provides a signal on a reset line 76. This signal is applied to the reset terminal of several of the flip flops. It is sufficient to return or restore them to a reset condition. They are arranged in the circuit to require a high output from the high terminal to operate the various circuits connected to the flip flops 43, 44, 45 and 46. By and large, the signal on the conductor 73 is used to indicate a malfunction which requires a shutdown.

The flip flop 46 provides an output which turns on a high voltage power supply 79. The voltage on conductor 39 provides a regulated high voltage from the supply 79 to the target high voltage supply circuit 13 as previously discussed. To assure that an adequate voltage is provided for the target, the voltage on the conductor 39 is monitored. The conductor 39 provides an input to a differential amplifier 80 connected as a voltage comparator. There are suitable voltage dividers forming references associated with the comparator 80 so that it forms an output on the conductor 81 indicating an adequate high voltage. The conductor 81 provides an input to the NOR gate 69 just mentioned, and also connects to the gate 65 previously mentioned. This enables the flip flop 45. That flip flop forms an output on the conductor 38 which continues replenisher current flow, the conductor 38 being input to the replenisher current control circuit 18 as previously described. If the high voltage is not adequate as determined by the comparator 80, this voltage comparator forms a low or false output.

Sequence of Operations

Assume that the hereinbefore described apparatus has been installed with a pulsed neutron generator tube which is, in turn, operated by equipment represented in the previously referenced patent. Assume further that the equipment is operative and that no difficulties arise with the operation of the components when the device is lowered into a borehole. Assume further that the device will be switched on from a complete off condition. Assume further that normal operation is desired whereby the target is provided with a high voltage of about 100 to about 125 KV and the ion source pulses are about 2,000 volts. Assume further that a normal replenisher current is about two amperes. Further assume that the external SF6 gas pressure associated with the pulsed neutron generator tube is sufficiently high to be deemed normal. In these normal operating conditions, the functioning of the system will now be described.

Adequate external SF6 gas pressure closes the switch 41 which forms the true signal on the conductor 42 previously described. This, of course, is input to the flip flop 43. Flip flop 43 is set by the clock 40 when line 42 is true and forms an output for the gate 51, assumed to be enabled at this point, and thereby forms an enable signal on the conductor 33. The conductor 33 enables the gate 32 and permits pulses to be provided to the pulsed ion source control circuit 34. Pulses are formed by that circuit and output to the ion source 20 via the conductor 21. In addition, the pulses are sampled for the conductor 37 which inputs these pulses to the pulse rate counter 54. Assuming the count is sufficient, an output is formed on the conductor 55 which is input to the gates 56 and 69. This turns on the flip flop 44 which is associated with the high voltage power supply 59. Flip flop 44 forms a voltage signal which is observed on the conductor 60 which provides a voltage suitable for operation of the high current supply 15. This, in turn, provides power for the replenisher of tube 12, through the conductor 16, provided the VMOS power FET 17 has been properly switched. That, in turn, depends on the signal on the conductor 38. Assuming for the moment that signal is adequate for operation, the replenisher current is then furnished to the tube 12.

The signal on conductor 38 is switched on by the signal from the gate 65 operating through the flip flop 45. This, in turn, is dependent on the signal input on the conductor 28. The conductor 28 is derived from sampling the target current. It will recalled that target current flows in the conductor 14, and a portion of the target current is sampled by the resistance divider, this signal is adequately amplified and applied to the conductor 28. The conductor 28 is input to two voltage comparators. They sense target current levels in a specified range. In particular, they sense improper current levels but, if the current is adequate, this is signaled on the conductors 62 and 68. The conductor 62 is input to the gate 63 which, in turn, conditions the gate 65. The gate 65 toggles the flip flop 45 to the on condition. This sequence forms the signal on the conductor 38 just mentioned. Moreover, the high limit of target current is signaled on the conductor 68 which is input to the gate 69, and this drives the signal for the gate 71. High current at the target is considered to be a catastrophic condition. It is indicative of excessive current which may exceed the rated specifications of the neutron tube apparatus, and to this end, the flip flop 72 serves as a malfunction device, thereby forming a signal on the conductor 76 which shuts down the equipment.

From the foregoing, it can be observed that the system forms a protective device for pulsed neutron generator tubes. They are expensive and difficult to service in the field. In light of the relative cost of the equipment and the difficulty in servicing the equipment, it is highly desirable to protect this equipment. This system functions with three basic operative modes in addition to the completely off condition. The first is the power turn on sequence. The second is normal operation which is monitored continuously. The third is a malfunction shutdown. On a malfunction shutdown, the equipment is basically all terminated simultaneously. Thus, normal operation monitors for target currents in excess of 200 microamperes, the specified maximum value. It is also monitored for high voltage by the voltage comparator 80. A loss in voltage is treated as a malfunction. Another malfunction condition is loss of high voltage ion source pulses. Accordingly, the malfunction flip flop 72 causes reset of the other flip flops. Once this occurs, the system is so constructed that the neutron generator tube is completely switched off. All the equipment is off and the entire cycle of operation is reinitiated to see if the equipment will operate again. The power is thus applied in a sequence utilizing the system of the present invention to determine if the pulsed neutral generator tube can again be switched on.

The foregoing is directed to the preferred embodiment, but the scope of the present invention is determined by the claims which follow.

I claim:

1. A protective system to be used with a neutron generator tube having an ion source, a target and a replenisher in well logging apparatus wherein the tube operates with a high voltage supply for keeping the target at high voltage, a replenisher current in a specified range, an ion source, and wherein a target current of a specified value in said generator tube is desired for efficient operation of said tube, the apparatus comprising:

(a) first means for monitoring target current in said generator tube and for generating a signal representative thereof;

(b) second means for monitoring ion source pulses in said generator tube and forming a signal representative thereof;

(c) third means for monitoring replenisher current flow in said generator tube and forming a signal representative thereof; and (d) fourth means responsive to signals from said first, second and third means for enabling application of high voltage power to the neutron tube to activate said neutron generator tube to an operative state, said fourth means continuing in operation in response to said first, second and third signals input thereto for the duration of operation of the neutron tube, and additionally forming enable signals indicative of the continued operation of the neutron tube within specified limits for input to said high voltage supply.

2. The apparatus of claim 1 wherein said first means comprises:

(a) target current sampling means forming a voltage signal proportional to target current;

(b) comparator means connected to said target current sampling means for testing the signal therefrom in comparison with a reference value; and (c) an output from said comparator means for providing a binary indication of the testing of said comparator means for input to said high voltage supply.

3. The apparatus of claim 2 wherein said comparator tests for a target current which is below the reference value.

4. The apparatus of claim 2 wherein said comparator means tests for a target current which is above the reference value.

5. The apparatus of claim 2 wherein said comparator means tests for current values in the range of 50 to 500 microamperes.

6. The apparatus of claim 1 wherein said second means comprises for counting pulses applied to said ion source to determine pulse rate in a specified range and forming an output signal indicative of pulses rates within the specified range for input to said high voltage supply.

7. The apparatus of claim 6 wherein said second means includes:

(a) pulse forming means;

(b) an enabling circuit controlling operation of said pulse forming means;

(c) sampling means connected to said pulse forming means for obtaining pulses therefrom; and (d) pulse rate counting means connected to said sampling means for forming an output indicative of a specified pulse rate for input to said high voltage supply.

8. The apparatus of claim 1 wherein said third means comprises:

(a) replenisher current power supply means for forming a current for the replenisher of the neutron tube;

(b) said replenisher current power supply means including an enable input for switching said power supply means on;

(c) a current control switch means connected between said replenisher current power supply means and the neutron generator tube replenisher and also having an enable signal input terminal for controlling operation thereof;

(d) means for forming an enable signal for the enable input of said replenisher current power supply means;

(e) means for forming an enable signal for control of said current control switch means;

(f) wherein said current control switch means modifies the current flow to the replenisher of the neutron generator tube; and (g) wheein said replenisher current power supply means, when enabled, supplies the current for the replenisher of the neutron tube.

9. A protective circuit to be used with a neutron generator tube in well logging apparatus wherein the tube is housed in an outer envelope filled with an insulating gas, a high voltage power supply and the neutron generator tube has a target current flowing in said tube, the apparatus comprising:

(a) first means for monitoring the pressure of the insulating gas in said outer tube envelope and for generating a gas pressure signal representative thereof; and (b) second means responsive to said signal from said first means for enabling application of high voltage power to the neutron tube to activate the neutron generator tube to an operative state, said second means continuing in operation for the duration of operation of the neutron generator tube, dependent on said gas pressure signal from said first means.

10. A protective circuit to be used with a pulse neutron generator tube in well logging apparatus wherein the tube operates with a high voltage supply connected to a target in the tube and wherein the target has a target current flowing in the tube of a specified value, the apparatus comprising:

(a) first means for monitoring the target current and for generating a target current signal representative thereof;

(b) second means for monitoring voltage of the high voltage supply and forming a signal representative thereof; and (c) third means responsive to said signals from said first and second means for enabling application of high voltage from said high voltage supply to said neutron generator tube to sustain said neutron generator tube in an operative state.

11. The apparatus of claim 10 wherein said first means comprises:

(a) target current sampling means forming a voltage output signal proportional to target current;

(b) comparator means connected to said target current sampling means for testing said output signal therefrom in comparison with a reference signal value; and (c) an output signal from said comparator means for providing a binary indication of the testing of said signal from said comparator means.

12. The apparatus of claim 11 wherein said second means is connected to comparator means for comparing against a reference voltage to determine that said representative output signal exceeds the reference voltage.

* * * * *